United States Patent [19]

Brandt

[11] Patent Number: 5,069,625

[45] Date of Patent: Dec. 3, 1991

[54] CONNECTOR FOR CONNECTING A PLURALITY OF INDIVIDUAL AT LEAST PARTIALLY INSULATED CONDUCTORS WITH ELECTRICAL CONTACTS

[75] Inventor: Konrad Brandt, Wedel/Holstein, Fed. Rep. of Germany

[73] Assignee: Minnesota Mining and Manufacturing Company, St. Paul, Minn.

[21] Appl. No.: 670,080

[22] Filed: Mar. 15, 1991

[51] Int. Cl.[5] ..... H01R 4/24

[52] U.S. Cl. ..... 439/404; 439/417

[58] Field of Search ..... 439/389–425

[56] References Cited

U.S. PATENT DOCUMENTS

| | | | |
|---|---|---|---|
| 3,333,229 | 7/1967 | Dean et al. | 439/417 |
| 3,668,301 | 6/1972 | Faulconer | 174/88 |
| 3,910,672 | 10/1975 | Frantz | 439/417 |
| 4,073,560 | 2/1978 | Anhalt et al. | 439/404 |
| 4,270,831 | 6/1981 | Takahashi | 339/99 |
| 4,441,779 | 4/1984 | Foederer et al. | 439/404 |

FOREIGN PATENT DOCUMENTS

| | | |
|---|---|---|
| 0203097B1 | 8/1989 | European Pat. Off. . |
| 2941029C2 | 8/1988 | Fed. Rep. of Germany . |

*Primary Examiner*—Joseph H. McGlynn

*Attorney, Agent, or Firm*—Gary L. Griswold; Walter N. Kirn; John C. Barnes

[57] ABSTRACT

A connector for use with closely spaced electrical leads or wires comprising a contact element of conductive material having U-shaped contact legs and an inverted T-shaped pressing element to strip insulation to make spring contact with the electrical lead or wire and the U-shaped contact legs.

8 Claims, 1 Drawing Sheet

CONNECTOR FOR CONNECTING A PLURALITY OF INDIVIDUAL AT LEAST PARTIALLY INSULATED CONDUCTORS WITH ELECTRICAL CONTACTS

The invention refers to a connector for connecting a plurality of individual at least partially insulated conductors with electrical contacts, particularly of a flat cable having a plurality of closely spaced conductors.

PRIOR ART

Above all, in the microelectronics there is a growing tendency to miniaturization and the continued necessity of reliably connecting a plurality of closely spaced wires or conductors with electrical contacts, with the wires being for example discrete individual wires or so-called flat cables. Usually, the contact elements have a pin at one end or a receptacle at one end of the forked or wiping type and being arranged in two or more rows on a retaining body and being adapted to receive pins of a matched plug device. The distances between the receptacle or the pluq pins, respectively, are standardized.

It is generally known to establish the electrical connection with a plurality of wires by a plurality of insulation displacing U-shaped contact elements which engage the wires concurrently. It is further known to press the wires into slotted contact elements in the retaining body by means of a pressing body so that the contact elements pierce the insulation of associated wires and make an electrical connection. The pressing body includes recesses or pockets into which the free ends of the cutting contact elements are plunged.

The width of the legs of the U-shaped contact elements is not to fall below a predetermined value if a predetermined resilient contact force is to be applied to the conductor. On the other hand, the width of the leg determines the lower limit for the pitch for example of the conductors of a flat cable.

From the German patent specification 29 41 029, a contact element is known including three prongs for each conductor, a first and a second prong being oppositely located and having a distance from each other while a third prong is located in the gap between the first and the second prong. The prongs define a slot into which a conductor can be pressed with the edges of the prongs facing the slot being chamfered. With the known contact element, it is intended to build a connector having small outer dimensions. However, the dimension of the connector in the direction of the wires is relatively large which above all has an effect if more than one row of contact elements is required.

The conductors of flat cables are surrounded by an approximately circular insulation, with the individual insulations being interconnected by webs. In case of U-shaped contact elements, the opposing edges of the legs penetrate through the insulation and engage the conductor under a pressure which slightly deforms the conductor. The achievable non-positive engagement between conductor and contact legs is sufficient to generate a constant contact force. However, also flat wires are known existing in the form of flexible circuits or conductor sheets. Such flat wires are either completely or partially insulated. If such flat wires are to be engaged by U-shaped contact elements, the wires may roll up between the legs so that a sufficient engagement with the contact legs cannot be achieved.

From the U.S. Pat. No. 3 668 301 connector means have become known, wherein a retaining body has channel-like guides, each receiving a pair of insulated wires. A recess is formed in the bottom of the guides into which contact inserts of metallic material are placed. By means of pressing elements, the pairs of wires are pressed into the conically tapering inserts, while the pressing elements penetrate the insulation. Furthermore, the insulation is squeezed off in the lower portion of the metallic inserts so that the metallic inserts contact the conductors which then are electrically interconnected. With the known connector means, the force which is necessary for the maintenance of the contact pressure is to be applied by a structural element retaining the pressing elements. This necessitates that the structural element is fixedly positioned relative to the retaining body. Since these parts usually are of plastic material, a satisfactory permanent contact force cannot be achieved due to the cold flow properties of plastic material.

From the mentioned publication, it has also become known to cut off the conductors to be interconnected by a sharp edge of the recesses. The ends of the conductors are completely pressed into the recesses.

The present invention provides connector means for connecting a plurality of at least partially insulated wires with electrical contacts wherein the conductors independent from their cross-sectional shape can be brought into engagement with contact elements with a predetermined constant contact force independent of whether the conductors have a small pitch.

SUMMARY OF THE INVENTION

Similar to the prior art, the present invention provides metallic U-elements which, according to an embodiment of the invention can be formed of sheet material. In the connector according to the invention, however, the legs are located in a plane which intersects the conductor. In the connector according to the invention, the pressing elements are inversely T-shaped, the transverse portion thereof having pressing portions at the free ends thereof. The length of the transverse portion and the distance between the contact legs are selected such that upon pressing the pressing elements between the contacts of the U-elements the conductors are bent around the inner edges at the free end of the contact legs and the pressing portions engage the conductor transverse to the longitudinal extension of the conductor, and the conductor is pressed against the contact surfaces under resilient pressure. If the conductors are completely covered by an insulation, this is squeezed off or displaced by the inner edges at the free end of the legs, and the pressing portions pierce into the insulation transverse to the longitudinal direction of the conductors. If the conductor has an insulation on one side only, this is either squeezed off or displaced by edges of the contact legs or is penetrated by the pressing portions. In any case, an effective electrical contact between the conductors and the contact elements is achieved independent of the kind of insulation for the conductors.

The contact force is predetermined by the geometry of the U-shaped contact elements and the pressing elements. They form a closed force system which includes only metallic parts. By this, a permanent contact force is achieved. The contact elements can have any desired geometry since an enlargement of the legs has no influence if applied to conductors having a small pitch. The resilient contact pressure above all is generated by the legs of the U-shaped contact elements. The connector according to the invention advantageously can also be applied to connections of flat wires with electrically conductive contacts The flat wires are deformed in the same manner as round wires and brought into engagement with the contact elements under a predetermined resilient pressure by a deformation about their longitudinal axis. It is prerequisite for a reliable contact for both kinds of conductors that the conductors are accurately guided. In connection with flat cables, an embodiment of the invention provides that the guides include ribs extending between the U-elements beyond the free edges of the resilient legs and which also extend into the space formed between the legs and the web interconnecting the legs. Such a guide cannot be used for flat wires. In case of a conductor sheet including a plurality of flat wires, it is sufficient for an accurate guidance that the lateral edges of the sheet are precisely guided. The known conductor sheets have relatively sharp edges and are relatively stiff in transverse direction. A lateral guide, therefore, is sufficient to align the flat wires, each with a U-shaped contact element and the pressing elements.

According to a further embodiment of the invention, the T-shaped pressing elements are made of metal or ceramic. They also can be made of plastic material, however, plastic material may be subject to deformation due to its cold flow properties upon a permanent load.

According to a further embodiment of the invention, retaining body and pressing body can be formed of plastic material, and the pressing elements and/or the U-shaped contact elements are preferably molded into the plastic material.

Usually, the electrical terminals, for example receptacles, are connected to the U-shaped contact elements. However, it is conceivable to connect receptacles or pins with the pressing elements if made of metal. According to a further embodiment of the invention, the pressing elements can be connected with other electrical terminals to connect them with a specific electrical circuitry.

Summarizing, it can be stated that the connector according to the invention allows the connection of a plurality of conductors with electrical contacts with an extremely small pitch without affecting the insulation of adjacent conductors by the contact elements. Also in connection with very small pitches, a sufficient and permanent contact force can be achieved by the contact elements and thus a reliable electrical connection. Finally, the connector according to the invention is also suited for the connection of a plurality of flat wires with contact elements. The flat wires are reliably contacted by means of the contact and pressing elements according to the invention.

The invention will be subsequently described by means of an embodiment example in connection with the accompanied drawings.

DETAILED DESCRIPTION OF THE DRAWINGS

Figure 1:
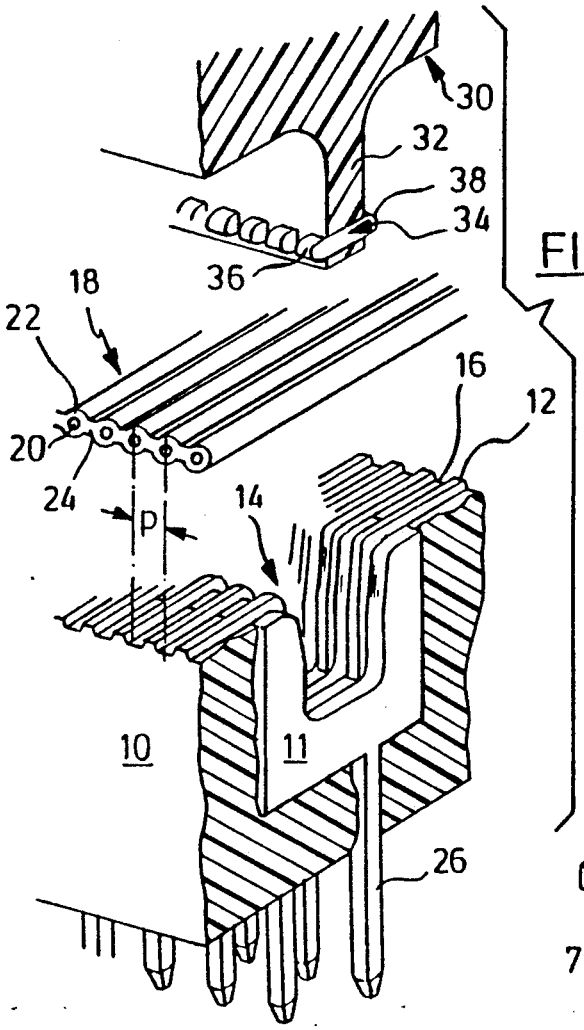
FIG. 1 is a perspective view of parts of the connector according to the invention prior to the connection with a flat cable.

In FIG. 1, a block-like retaining body 10 is indicated which can be formed of plastic material. The retaining body accommodates a row of U-shaped contact elements 11 which are embedded into the material of the retaining body, e.g. by injection molding of the plastic material. The upper or support surface of the retaining body 10 includes parallel ribs 12 trapezoidal in cross section which extend between the contact elements 11, each rib being located in a plane parallel to the plane extending through the legs of the contact elements 11. The ribs extend beyond the free end of the contact legs into passage 14 defined by the legs of the contact elements 11 and portions of the retaining body therebetween. The guiding ribs 12 form guiding passages 16. The pitch p of the guiding passages 16 corresponds to the pitch of the conductors of a flat cable 18 shown above retaining body 10. The conductors 20 of flat cable 18 are surrounded by an insulation 22 interconnected by webs 24 between the conductors. Upon placing the flat cable 18 onto the support surface of retaining body 10, the individual cables of the flat cable come to lie in the guiding passages 16 between ribs 12.

A pressing body 30 can be seen above flat cable 18, having a downwardly extending narrow web portion 32. Elongated pressing elements 34 are embedded into web portion 32 which have rounded pressing portions 36, 38 at opposing ends. The pitch of pressing elements 34 corresponds to the pitch of flat cable 18 or of guiding passages 16, respectively. Retaining body 10 and pressing body 30 are guided by guiding means not shown such that upon a pressing of retaining body and pressing body against each other, a pressing element 34 is aligned with a respective contact element 11. The width of the pressing elements substantially corresponds t the thickness of contact elements 11.

Pins 26 are formed to the lower side of the webs of contact elements 11, the pins for example coacting with receptacles of a matching connector part.

An electrical connection of the conductors 20 of flat cable 18 with the contact elements is achieved in that pressing body 30 is pressed against retaining body 10. The deformation of the flat cable 18 occurring in this connection will be explained in detail by means of FIG. 3. The design of the pressing and the contact elements, respectively, deviate from that shown in FIG. 1. Similar or equivalent parts are designated by the same reference numbers with the foregoing embodiment, however, being added by index a. As can be seen, web **32*a* is integrally formed with pressing elements 34*a* and can be an electrical terminal. The U-shaped contact element 11*a* includes legs 40, 42 resiliently connected to web 44. The length of the transverse portion 34*a* of the pressing element is smaller than the width of the space 46 defined by legs 40, 42 and web 44, however, is larger than the width of space 46 plus twice the diameter of conductor 20. Upon pressing of pressing body 30 and retaining body 10 against each other, the pressing element 34*a* laterally engages insulation 22 and deforms the respective conductor portion to a U-shape toward the accommodation space 46. The pressing portions 36*a*, 38*a* penetrate the insulation approximately perpendicularly to the axis of the conductor and mechanically engage conductor 20. Conductor 20 is slightly compressed as can be clearly seen in FIG. 3. Owing to the pressure between pressing portions 36***a*, 38*a* and the facing edges 50, 52 of legs 40, 42, the insulation is squeezed away in the area of the edges, and the conductor is partially engaged by edges 50, 52. During this operation, the resilient legs 40, 42 are slightly deflected away from each other, and web 44 is also subject to a bending force. Legs 42, 44 exert a resilient contact force onto conductor 20. Since the force exterted by pressing portions 36*a*, 38*a* is approximately perpendicular to legs 40, 42, an effective non-positive engagement is achieved accomplishing a sufficient permanent contact force and preventing the conductor from being moved out of space 46 of contact element 11*a* due to its internal tension force or by other forces.

Figure 3:
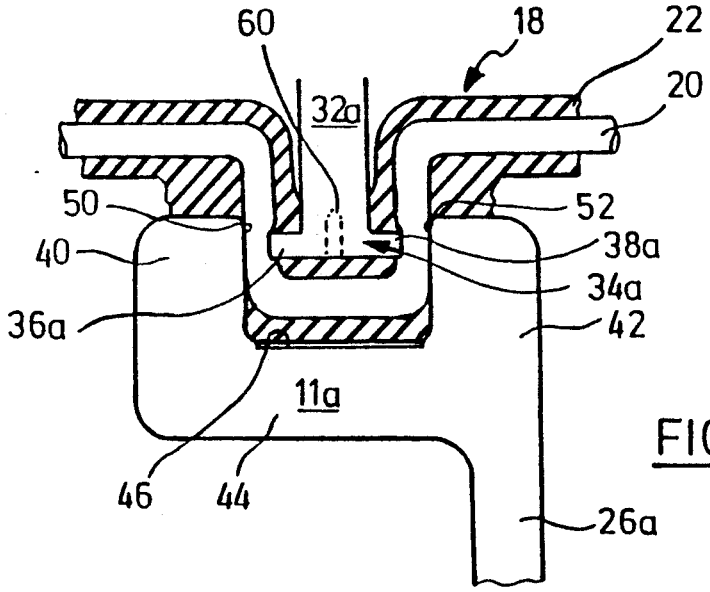
FIG. 3 is a cross section through the connection of an individual wire with a contact element in a connector according to FIG. 1.

If legs 40, 42 are designed to be somewhat deflected, it is required that the legs are located in retaining body 10 for a limited movement. However, it is also possible to hold the legs 40, 42 fast if the pressing element 34*a* has resilient properties. This is indicated by the dash-dotted line 60 in FIG. 3 illustrating a slot partially parting the pressing element 34*a* so that the pressing portions 36*a*, 38*a* are relatively movable.

It can be seen that the minimum pitch a flat cable 18 may have is determined by the minimum distance between the U-shaped contact elements. This distance can be made very small so that a flat cable with a very small pitch can be effectively connected with contact elements 11.

Figure 2:
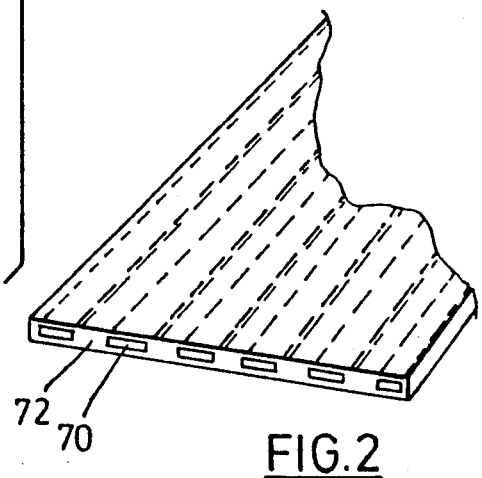
FIG. 2 is a perspective view of a sheet conductor arrangement which can be applied instead of the flat cable of FIG. 1.

In FIG. 2, flat wires 70 are shown extending parallel and spaced from each other. The wires 70 are embedded in sheet material 72 of flexible synthetic material. Such sheet conductors are frequently applied to electronics. In some cases, the flat wires 70 are insulated only on one side. Such sheet conductors as shown in FIG. 2 can also be connected with contact elements 11 of the connector of FIG. 1 as has been described in detail with the aid of FIG. 3. Merely, the guiding ribs 12 of retaining body 10 are to be omitted. In this case, the support surface of retaining body 10 is flat. Further a guidance (not shown) is to be provided coacting with the lateral edges of the conductor arrangement of FIG. 2 to achieve that the flat wires 70 are aligned with the associated contact elements 11 when pressing body 30 and retaining body 10 are pressed against each other and the flat wires 70 are deformed into the accommodation spaces 46 of contact elements 11, 11*a*.

I claim:

1. Connector means for connecting a plurality of at least partially insulated conductors with electrical contacts, particularly of a flat cable having closely spaced conductors, said connector means comprising a retaining body retaining at least one row of contact elements, each of said contact elements having a pair of spaced opposing contact surfaces extending transverse to the longitudinal axis of said conductors, said retaining body including guiding means between said contact elements, and comprising a pressing body including a row of pressing elements having a width smaller than the distance between said contact surfaces of said contact elements and adapted to press a respective conductor between said contact surfaces of said pair of said contact surfaces when said retaining body and pressing body are pressed against each other such that the insulation is partially displaced and portions of said conductor freed from said insulation conductively engage said contact surfaces, characterized in that said contact surfaces are formed with contact legs of metallic U-elements, said pressing elements having an inversely T-shaped portion including a transverse portion, said transverse portion having pressing portions at the free end thereof, with the length of said transverse portion and said distance between said contact legs being selected such that upon pressing said pressing elements between said contact legs of said U-contacts, said conductors are bent around the inner edge at the free end of said contact legs and the insulation, if any, is displaced, and in that said pressing portions engage said conductor transverse to the longitudinal direction of said conductor and penetrates said insulation, if any, so that conductor portions free from said insulation are pressed against said contact surfaces under a resilient pressure by said pressing portions acting on said conductor portions perpendicular to said longitudinal axis of said conductor portions.

2. The connector means of claim 1, wherein said retaining body is formed of plastic material and said U-elements are preferably embedded into the plastic material.

3. The connector means of claim 1, wherein the T-shaped pressing elements are formed of metal or ceramic.

4. The connector means of claim 1 or 3, wherein said pressing portions of said transverse portion are resilient.

5. The connector means of claim 1 or 3, wherein the pressing elements are retained by a pressing body of plastic material, preferably embedded into the plastic material.

6. The connector means of claim 3, wherein the pressing elements are provided with electrical terminals.

7. The connector means of claim 1, wherein the U-shaped elements are formed of conductive sheet material, and said guides are formed by ribs located between said U-elements and extend into the space formed between said legs and the web interconnecting said legs.

8. The connector means of claim 7, wherein said guiding ribs extend beyond the free end of said contact legs and into the passageway defined by said legs of said metallic U-elements.

* * * * *